US010746182B2

(12) United States Patent
Nakagawa et al.

(10) Patent No.: US 10,746,182 B2
(45) Date of Patent: Aug. 18, 2020

(54) MULTI-STAGE COMPRESSOR SYSTEM, CONTROL DEVICE, MALFUNCTION DETERMINATION METHOD, AND PROGRAM

(71) Applicant: MITSUBISHI HEAVY INDUSTRIES COMPRESSOR CORPORATION, Minato-ku (JP)

(72) Inventors: Yosuke Nakagawa, Tokyo (JP); Naoto Yonemura, Hiroshima (JP); Hiroyuki Miyata, Hiroshima (JP); Naoki Mori, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 420 days.

(21) Appl. No.: 15/314,377

(22) PCT Filed: Jun. 22, 2015

(86) PCT No.: PCT/JP2015/067896
§ 371 (c)(1),
(2) Date: Nov. 28, 2016

(87) PCT Pub. No.: WO2016/002565
PCT Pub. Date: Jan. 7, 2016

(65) Prior Publication Data

US 2017/0198704 A1 Jul. 13, 2017

(30) Foreign Application Priority Data

Jul. 1, 2014 (JP) ..... 2014-136051

(51) Int. Cl.
*F04D 27/00* (2006.01)
*F04D 25/16* (2006.01)
(Continued)

(52) U.S. Cl.
CPC ..... *F04D 27/001* (2013.01); *F04B 49/10* (2013.01); *F04D 17/12* (2013.01); *F04D 19/007* (2013.01); *F04D 19/02* (2013.01); *F04D 25/163* (2013.01)

(58) Field of Classification Search
CPC .... F04D 27/001; F04D 27/0292; F04D 49/10; F04D 19/10; F04D 17/12; F04D 29/563;
(Continued)

(56) References Cited

U.S. PATENT DOCUMENTS 3,664,357 A * 5/1972 Kreiss ..... F17D 1/14 137/2
4,077,748 A * 3/1978 Potz ..... F02C 3/107 290/4 R
(Continued)

FOREIGN PATENT DOCUMENTS

CN 101387306 A 3/2009
CN 102027348 A 4/2011
(Continued)

OTHER PUBLICATIONS

Written Opinion of the International Searching Authority and the International Search Report (Forms PCT/ISA/210 and PCT/ISA/237), dated Sep. 29, 2015, for International Application No. PCT/JP2015/067896, with an English translation.
(Continued)

*Primary Examiner* — Charles G Freay
(74) *Attorney, Agent, or Firm* — Birch, Stewart, Kolasch & Birch, LLP

(57) ABSTRACT

A multi-stage compressor system is a system of a multi-stage compressor in which compressors are connected in series in a plurality of stages includes a control unit. The control unit determines whether a malfunction is present in the system by comparing a suction flow rate of a first-stage
(Continued)

compressor measured by a first sensor with a downstream flow rate from an outlet of the multi-stage compressor measured by a second sensor.

13 Claims, 5 Drawing Sheets

(51) Int. Cl.
*F04B 49/10* (2006.01)
*F04D 19/00* (2006.01)
*F04D 17/12* (2006.01)
*F04D 19/02* (2006.01)

(58) Field of Classification Search
CPC ..... F04D 29/462; F04D 19/02; F04D 25/16; F04D 27/009; F04D 27/0207; F04D 27/0215; F04D 27/0223; F04D 27/023; F04D 25/163; F04B 49/10
USPC ..... 417/251–253
See application file for complete search history.

(56) References Cited

U.S. PATENT DOCUMENTS 4,118,780 A * 10/1978 Hirano ..... C21B 7/103 702/45
4,139,328 A * 2/1979 Kuper ..... F04D 27/0284 415/1
RE30,329 E * 7/1980 Rutshtein ..... F04D 27/0284 415/1
4,815,950 A * 3/1989 Aoki ..... F04C 28/06 417/253
4,942,276 A * 7/1990 Kato ..... H01H 13/50 200/332
4,948,332 A * 8/1990 Blotenberg ..... F04D 27/0207 415/27
5,005,351 A * 4/1991 Archer ..... F28B 1/02 60/657
5,599,161 A 2/1997 Batson
6,503,048 B1 1/2003 Mirsky
6,561,766 B2 * 5/2003 Nishimura ..... F04C 23/001 417/243
8,749,393 B1 * 6/2014 Tollefson ..... G01M 3/2876 340/605
8,939,732 B2 * 1/2015 Kim ..... F04D 17/12 417/243
9,037,422 B2 * 5/2015 McHugh ..... G01M 3/3254 702/51
2009/0317260 A1 12/2009 Mirsky et al.
2010/0074725 A1 * 3/2010 Serbruyns ..... F04D 27/0261 415/1
2010/0179467 A1 * 7/2010 Gunther ..... A61M 1/3639 604/6.15
2010/0281843 A1 * 11/2010 Smith ..... F01D 17/08 60/39.091
2011/0112797 A1 5/2011 Nühse et al.
2011/0130883 A1 6/2011 Van Dijk
2012/0324985 A1 * 12/2012 Gu ..... G01F 25/0007 73/40.5 R
2013/0174649 A1 7/2013 Hains et al.
2014/0219820 A1 * 8/2014 Koki ..... F04D 25/06 417/19
2015/0139776 A1 5/2015 Takeda et al.
2015/0159670 A1 6/2015 Saito

FOREIGN PATENT DOCUMENTS

CN 102378888 A 3/2012
DE 102008021102 A1 10/2009
EP 0769624 A1 4/1997
GB 2 268 228 A * 5/1994
JP 55-123393 A 9/1980
JP 57-153237 A 9/1982
JP 62-48999 A 3/1987
JP 63-235697 A 9/1988
JP 2007-232259 A 9/2007
JP 2013-143136 A 7/2013
JP 2013-170573 A 9/2013
JP 2014-92138 A 5/2014
JP 2014-109264 A 6/2014
KR 10-1204900 B1 11/2012
SU 1765533 A1 9/1992

OTHER PUBLICATIONS

Chinese Office Action and Search Report for Chinese Application No. 201580027311.X, dated Sep. 4, 2017, with an English translation of the Chinese Office Action.

* cited by examiner

MULTI-STAGE COMPRESSOR SYSTEM, CONTROL DEVICE, MALFUNCTION DETERMINATION METHOD, AND PROGRAM

TECHNICAL FIELD

The present invention relates to a multi-stage compressor system, a control device, a malfunction determination method, and a program.

Priority is claimed on Japanese Patent Application No. 2014-136051, filed Jul. 1, 2014, the content of which is incorporated herein by reference.

BACKGROUND ART

A compressor which compresses gases and supplies the compressed gases to machines or the like connected to a downstream side of a gas system is known. As this compressor, there is a compressor in which a gas flow rate for a compressor body is adjusted by arranging an inlet guide vane (IGV) at an upstream side and adjusting the degree of opening of the IGV.

In Patent Document 1, technology of appropriately controlling a degree of opening of the IGV and performing an optimum operation even when a performance difference occurs between two first-stage compressor bodies among a plurality of compressor bodies is disclosed as related technology.

CITATION LIST

Patent Document

[Patent Document 1]

Japanese Unexamined Patent Application, First Publication No. 2013-170573

SUMMARY OF INVENTION

Technical Problem

By the way, in a multi-stage compressor as disclosed in Patent Document 1 when a flow rate meter provided in a first compressor is in an abnormal state and a result of measuring a gas flow rate higher than an actual gas flow rate is shown, an operation is performed at a low gas flow rate by correcting flow rate deviation on the basis of a result of erroneously measuring the gas flow rate. Thus, it is likely to be in a surge state. In this case, because the flow rate meter is in the abnormal state, anti-surge control for preventing the surge state using the flow rate meter is also likely not to be normally operated.

In addition, when a phenomenon in which an amount of leakage of a gas is increased by the breakdown or the like of the seal part occurs in the multi-stage compressor as disclosed in Patent Document 1, the leakage of the gas is unlikely to be detected.

Also, a method based on redundancy or the like is considered to detect a malfunction of a measuring instrument such as a flow rate meter. However, when the method based on redundancy is used, the cost is likely to increase.

Thus, technology capable of detecting a malfunction in the multi-stage compressor system without making a measuring instrument redundant is required.

The present invention provides a multi-stage compressor system, a control device, a malfunction determination method, and a program capable of solving the above-described problem.

Solution to Problem

According to a first aspect of the present invention, a multi-stage compressor system is a system of a multi-stage compressor in which compressors are connected in series in a plurality of stages, the multi-stage compressor system including: a control unit configured to determine whether a malfunction is present in the system by comparing a suction flow rate of a first-stage compressor measured by a first sensor with a downstream flow rate from an outlet of the multi-stage compressor measured by a second sensor.

According to a second aspect of the present invention, in the multi-stage compressor system, the multi-stage compressor includes a pair of first-stage compressors and subsequent-stage compressors, wherein the subsequent-stage compressors serially connected to the first-stage compressors compress fluids compressed by the pair of first-stage compressors.

According to a third aspect of the present invention, in the multi-stage compressor system, a measurement value of each of the first sensor and the second sensor is corrected according to at least one of a temperature of a fluid, a pressure of the fluid, and a molecular weight of the fluid in which the first sensor and the second sensor measure.

According to a fourth aspect of the present invention, in the multi-stage compressor system, a third sensor configured to measure an amount of drainage downstream generated from a compressed fluid from an outlet of the first-stage compressor is provided, and measurement values of the first sensor and the second sensor are corrected according to the amount of drainage measured by the third sensor.

According to a fifth aspect of the present invention, in the multi-stage compressor system, a pressure of a fluid is measured at an upstream side of the first sensor and a temperature of the fluid is measured at a downstream side of the first sensor.

According to a sixth aspect of the present invention, a control device is a control device for a multi-stage compressor in which compressors are connected in series in a plurality of stages, the control device including: a control unit configured to determine whether a malfunction is present in the system by comparing a suction flow rate of a first-stage compressor measured by a first sensor with a downstream flow rate from an outlet of the multi-stage compressor measured by a second sensor.

According to a seventh aspect of the present invention, in the control device, the multi-stage compressor includes a pair of first-stage compressors and subsequent-stage compressors, wherein the subsequent-stage compressors serially connected to the first-stage compressors compress fluids compressed by the pair of first-stage compressors.

According to an eighth aspect of the present invention, in the control device, a measurement value of each of the first sensor and the second sensor is corrected according to at least one of a measured temperature of a fluid, a measured pressure of the fluid, and a measured molecular weight of the fluid around the sensor.

According to a ninth aspect of the present invention, in the control device, a third sensor configured to measure an amount of drainage downstream generated from a compressed fluid from an outlet of the first-stage compressor is provided, and measurement values of the first sensor and the second sensor are corrected according to the amount of drainage measured by the third sensor.

According to a tenth aspect of the present invention, in the control device, a pressure of a fluid is measured at an upstream side of the first sensor and a temperature of the fluid is measured at a downstream side of the first sensor.

According to an eleventh aspect of the present invention, a malfunction determination method is a malfunction determination method for use in a system of a multi-stage compressor in which compressors are connected in series in a plurality of stages, the malfunction determination method including: determining, by a control unit, whether a malfunction is present in the system by comparing a suction flow rate of a first-stage compressor measured by a first sensor with a downstream flow rate from an outlet of the multi-stage compressor measured by a second sensor.

According to a twelfth aspect of the present invention, in the malfunction determination method, the multi-stage compressor includes a pair of first-stage compressors and subsequent-stage compressors, wherein the subsequent-stage compressors serially connected to the first-stage compressors compress fluids compressed by the pair of first-stage compressors.

According to a thirteenth aspect of the present invention, in the malfunction determination method, a measurement value of each of the first sensor and the second sensor is corrected according to at least one of a temperature of a fluid, a pressure of the fluid, and a molecular weight of the fluid in which the first sensor and the second sensor measure.

According to a fourteenth aspect of the present invention, in the malfunction determination method, a third sensor configured to measure an amount of drainage downstream generated from a compressed fluid from an outlet of the first-stage compressor is provided, and measurement values of the first sensor and the second sensor are corrected according to the amount of drainage measured by the third sensor.

According to a fifteenth aspect of the present invention, in the malfunction determination method, a pressure of a fluid is measured at an upstream side of the first sensor and the temperature of the fluid is measured at a downstream side of the first sensor.

According to a sixteenth aspect of the present invention, a program is a program configured to cause a computer of a control device for controlling a multi-stage compressor in which compressors are connected in series in a plurality of stages to function as: a control means configured to determine whether a malfunction is present in the system by comparing a suction flow rate of a first-stage compressor measured by a first sensor with a downstream flow rate from an outlet of the multi-stage compressor measured by a second sensor.

According to a seventeenth aspect of the present invention, the program causes the computer to function as: a means configured to correct a measurement value of each of the first sensor and the second sensor according to at least one of a measured temperature of a fluid, a measured pressure of the fluid, and a measured molecular weight of the fluid around the sensor.

According to an eighteenth aspect of the present invention, the program causes the computer to function as: a means configured to correct measurement values of the first sensor and the second sensor according to the amount of drainage measured by a third sensor configured to measure an amount of drainage downstream generated from a compressed fluid from an outlet of the first-stage compressor.

Advantageous Effects of Invention

According to the multi-stage compression system, the control device, the malfunction determination method, and the program described above, it is possible to detect a malfunction in a multi-stage compressor system without making a measuring instrument redundant.

DESCRIPTION OF EMBODIMENTS

First Embodiment

Figure 1:
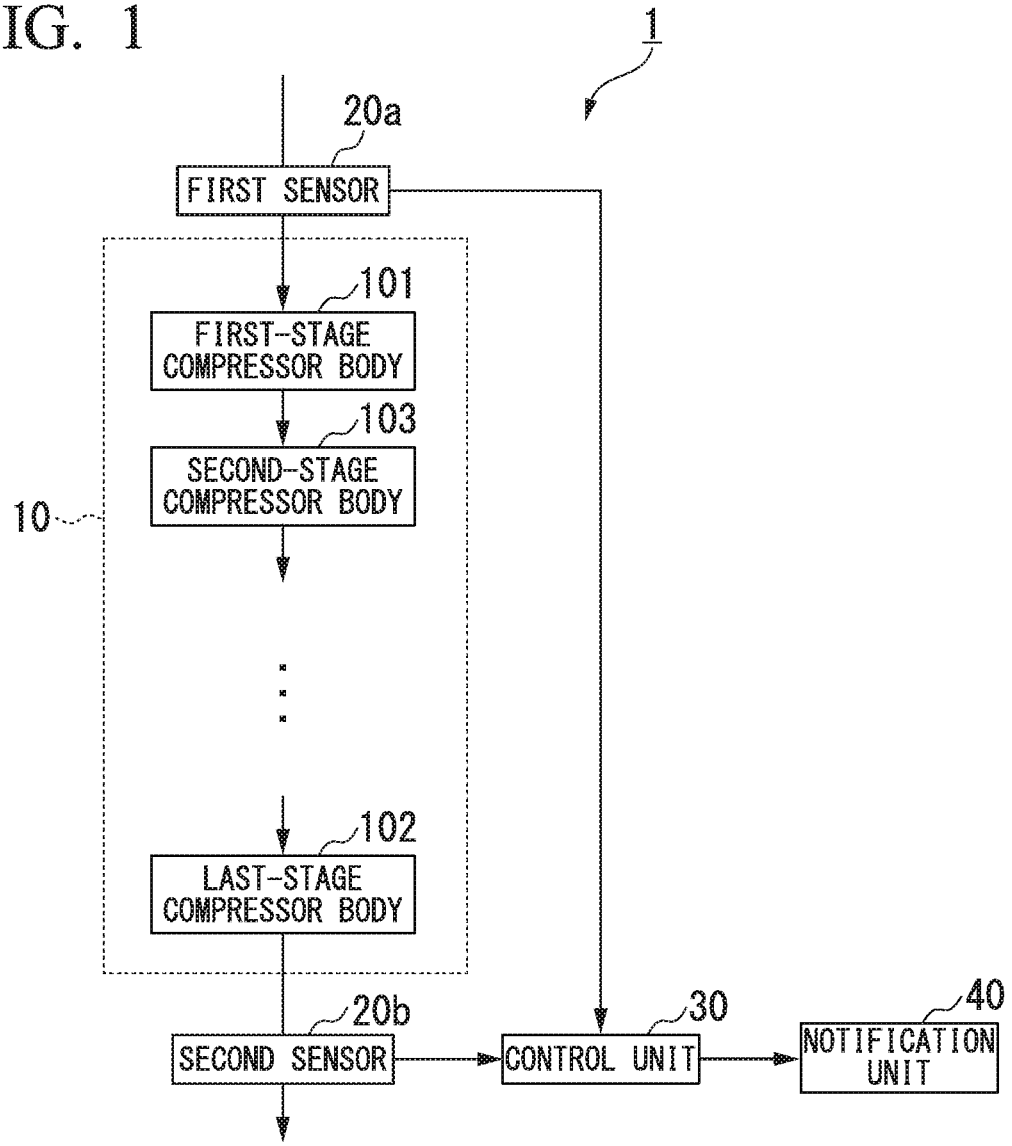
FIG. 1 is a diagram showing an example of a configuration of a multi-stage compressor system according to a first embodiment of the present invention.

FIG. 1 is a diagram showing an example of a configuration of a multi-stage compressor system 1 according to the first embodiment of the present invention.

As shown in FIG. 1, the multi-stage compressor system 1 according to the first embodiment includes a multi-stage compressor 10, a first sensor 20*a*, a second sensor 20*b*, a control unit 30, and a notification unit 40.

The multi-stage compressor 10 includes a first-stage compressor body 101, a last-stage compressor body 102, and a second-stage compressor body 103.

The first-stage compressor body 101 is a first-stage compressor body of the multi-stage compressor 10. The first-stage compressor body 101 takes in a gas and generates a compressed gas.

The last-stage compressor body 102 is a compressor body of a last stage of the multi-stage compressor 10. The last-stage compressor body 102 takes in a gas compressed in a previous stage and generates a compressed gas.

The second-stage compressor body 103 is connected to the first-stage compressor body 101 in series. The second-stage compressor body 103 takes in the gas compressed by the first-stage compressor body 101. The second-stage compressor body 103 compresses the taken in gas and discharges the compressed gas to a third-stage compressor body of a subsequent stage connected in series. Likewise, a compressor body of a stage subsequent to the third-stage compressor body is connected in series. Also, each compressor body of a stage subsequent to the third-stage compressor body similarly takes in a compressed gas, compresses the taken in gas, and outputs the compressed gas to a subsequent-stage compressor body.

The first sensor 20*a* measures a flow rate of a gas taken in by the first-stage compressor body 101.

The second sensor 20*b* measures a flow rate of a gas discharged by the last-stage compressor body 102.

The control unit 30 compares a gas flow rate measured by the first sensor 20*a* with a gas flow rate measured by the second sensor 20*b* and determines whether two measurement values are the same within a predetermined error range.

When it is determined that the two measurement values are the same within the predetermined error range, the control unit 30 determines that the multi-stage compressor system 1 is normal.

Also, when it is determined that the two measurement values are not the same within the predetermined error range, the control unit 30 determines that a malfunction is occurring in the multi-stage compressor system 1.

Also, when the multi-stage compressor system 1 is normal, this determination is based on the fact that all the gas taken in by the first-stage compressor body 101 is discharged by passing through the second-stage compressor body 103, the subsequent-stage compressor body, and the last-stage compressor body 102. When a measurement value of a flow rate of a gas taken in by the first-stage compressor body 101 is different from a measurement value of a flow rate of a gas discharged by passing through the second- and subsequent-stage compressor bodies including the last-stage compressor body 102, a malfunction of the measuring instrument is first considered. When no malfunction is found in the measuring instrument, the gas between the first-stage compressor body 101 and the second- and subsequent-stage compressor bodies is likely to have been leaked. When the gas is leaked between the first-stage compressor body 101 and the second- and subsequent-stage compressor bodies, there is a possibility of a breakdown of a seal part of the compressor.

When a flow rate measurement result from the first sensor 20*a* and a flow rate measurement result from the second sensor 20*b* are different, the control unit 30 notifies the user that some malfunction might be occurring in the multi-stage compressor system 1 via the notification unit 40. For example, the notification unit 40 is a display, a speaker, a vibration device, or the like. The notification unit 40 may display "Please confirm whether the measuring device is normal." or "Gas is likely leaking." or provide a notification by sound. Also, the notification unit 40 may cause the malfunction of the multi-stage compressor system 1 to be known by vibration.

Also, the control unit 30 may stop flow rate deviation correction when it is determined that a malfunction is likely to have occurred in the multi-stage compressor system 1. Also, the control unit 30 may control a blowoff valve 108 to be opened to a fixed degree of opening in order to prevent a surge operation. In addition, the control unit 30 may stop the system.

As described above, in the multi-stage compressor system 1, the control unit 30 compares the flow rates of gases taken in by the first-stage compressor body 101, which is measured by the first sensor 20*a*, with the flow rate of a gas discharged by the last-stage compressor body 102, which is measured by the second sensor 20*b*. When the flow rates of gases taken in by the first-stage compressor body 101, which is measured by the first sensor 20*a*, are different from the flow rate of a gas discharged by the last-stage compressor body 102, which is measured by the second sensor 20*b*, the control unit 30 determines that there is a possibility of a sensor malfunction or gas leakage in the multi-stage compressor system 1. The control unit 30 notifies the user of a possibility of some occurring malfunction in the multi-stage compressor system 1 via the notification unit 40.

Thus, the multi-stage compressor system 1 can detect a malfunction in the multi-stage compressor system 1 without making the measuring instrument redundant.

Second Embodiment

Figure 2:
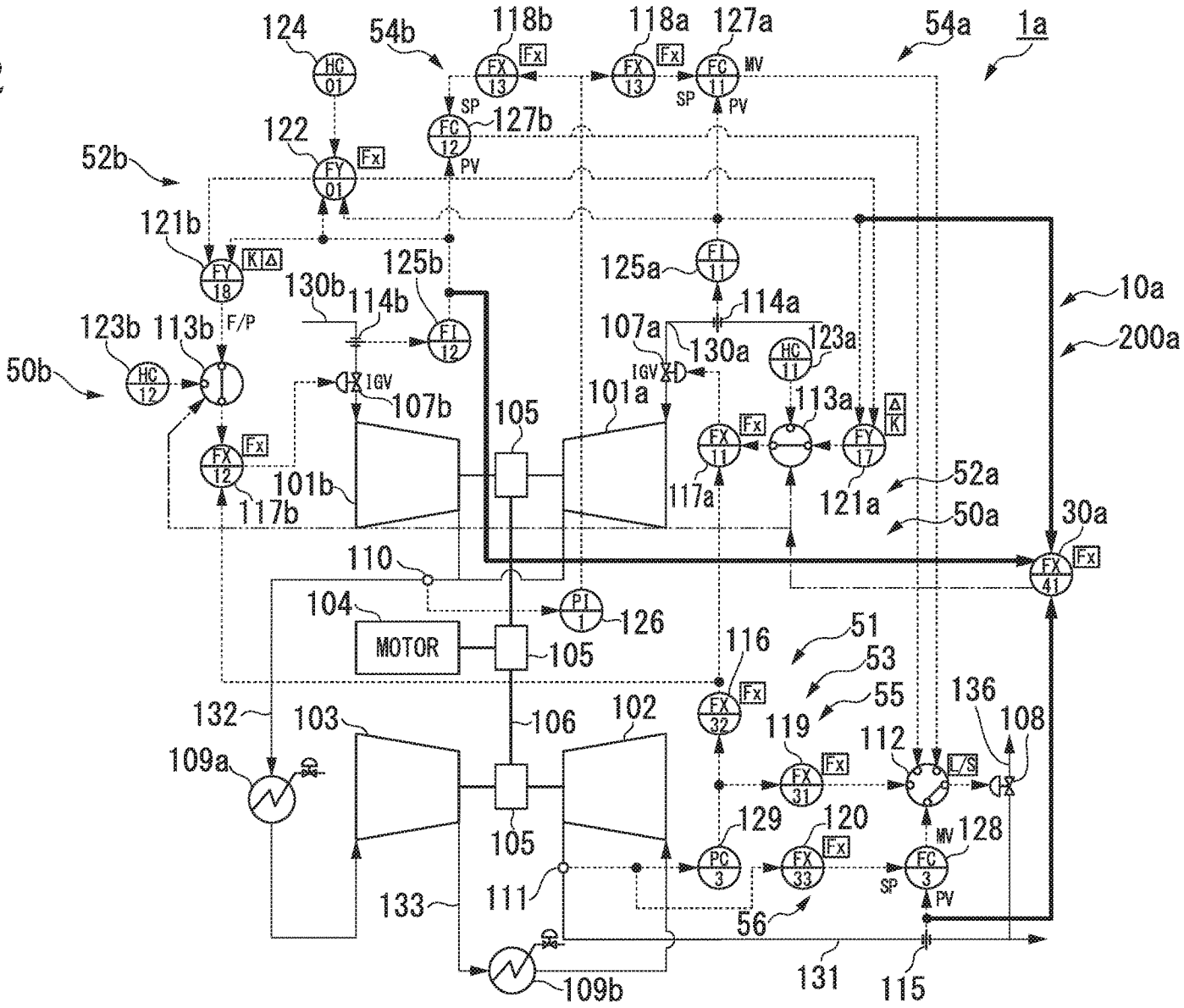
FIG. 2 is a diagram showing an example of a configuration of a multi-stage compressor system according to a second embodiment of the present invention.

FIG. 2 is a diagram showing an example of a configuration of a multi-stage compressor system 1*a* according to the second embodiment of the present invention.

The multi-stage compressor system 1*a* according to the second embodiment includes a multi-stage compressor 10*a* and a compressor control device 200*a* (a control device).

The multi-stage compressor 10*a* includes first-stage compressor bodies 101 (101*a* and 101*b*) arranged in series from an upstream side of a flow of a gas to a downstream side, a second-stage compressor body 103, and a last-stage compressor body 102. The first-stage compressor body 101 is formed of a pair including the first-stage compressor body 101*a* and the first-stage compressor body 101*b*.

The first-stage compressor bodies 101 (101*a* and 101*b*), the second-stage compressor body 103, and the last-stage compressor body 102 are coupled via a shaft 106. The first-stage compressor bodies 101*a* and 101*b* are arranged to form a pair in parallel on the upstream side of the shaft 106. On the downstream side of the shaft 106, the second-stage compressor body 103 and the last-stage compressor body 102 are arranged in parallel. A motor 104 is connected to a middle portion of the shaft 106. Each compressor body and the motor 104 are connected to the shaft 106 via a gearbox 105.

Supply lines 130*a* and 130*b* are pipes for supplying gases to the first-stage compressor bodies 101*a* and 101*b*. The supply line 130*a* is connected to an inlet of the first-stage compressor body 101*a*. Also, the supply line 130*b* is connected to an inlet of the first-stage compressor body 101*b*. The first-stage compressor body 101*a* generates a compressed gas by taking in the gas via the supply line 130*a* and compressing the gas. The first-stage compressor body 101*b* generates a compressed gas by taking in the gas via the supply line 130*b* and compressing the gas.

A first connection line 132 is a pipe for supplying the compressed gas generated by the first-stage compressor bodies 101*a* and 101*b* to the second-stage compressor body 103. The first connection line 132 is connected to an outlet of the first-stage compressor body 101*a* and an outlet of the first-stage compressor body 101*b*. Also, the first connection line 132 is connected to an inlet of the second-stage compressor body 103. The first connection line 132 includes a merging portion and the compressed gases discharged by the two first-stage compressor bodies 101*a* and 101*b* are merged in the merging portion. The first connection line 132 supplies the merged compressed gases to the second-stage compressor body 103.

The second-stage compressor body 103 generates a compressed gas by further compressing the compressed gas taken in via the first connection line 132. A second connection line 133 is a pipe for supplying the compressed gas generated by the second-stage compressor body 103 to the last-stage compressor body 102. The second connection line 133 is connected to an outlet of the second-stage compressor body 103 and an inlet of the last-stage compressor body 102. The second connection line 133 supplies the compressed gas to the last-stage compressor body 102.

The last-stage compressor body 102 generates a compressed gas by further compressing the compressed gas taken in via the second connection line 133. A discharge line 131 is a pipe for supplying the compressed gas generated by the last-stage compressor body 102 to a downstream process. The discharge line 131 is connected to an outlet of the last-stage compressor body 102 and an inlet of the downstream process. The discharge line 131 supplies the compressed gas to the downstream process.

An inlet guide vane (hereinafter, IGV) 107*a* is provided in the supply line 130*a* around the inlet of the first-stage compressor body 101*a*. An IGV 107*b* is provided in the supply line 130*b* around the inlet of the first-stage compressor body 101*b*. The IGV 107*a* provided in the supply line 130*a* controls a flow rate of the gas flowing into the first-stage compressor body 101*a*. The IGV 107*b* provided in the supply line 130*b* controls the flow rate of the gas flowing into the first-stage compressor body 101*b*.

The discharge line 131 around an outlet of the last-stage compressor body 102 is provided with the blowoff valve 108. When the compressor is a compressor in which the gas to be compressed is air, the blowoff valve 108 provided in the discharge line 131 discharges air into the atmosphere via a blowoff line 136. Also, when the gas is nitrogen or the like, a recycle valve can be used. In this case, the blowoff valve 108 can return the gas to the supply line 130*a* via a recycle line by which the blowoff line 136 is connected to the supply line 130*a*. Also, the blowoff valve 108 can return the gas to the supply line 130*b* via the recycle line in which the blowoff line 136 is connected to the supply line 130*a*.

Because the IGV 107*a*, the IGV 107*b*, and the blowoff valve 108 control the outlet pressure of the compressor or avoid surging, its degree of opening is controlled.

An inlet flow rate determination unit 114*a* is arranged at the supply line 130*a*. The inlet flow rate determination unit 114*a* determines the inlet gas flow rate of a gas flowing into the first-stage compressor body 101*a* and generates an inlet flow rate determination value. An inlet flow rate determination unit 114*b* is arranged at the supply line 130*b*. The inlet flow rate determination unit 114*b* determines an inlet gas flow rate of a gas flowing into the first-stage compressor body 101*b* and generates an inlet flow rate determination value.

A post-merger pressure determination unit 110 is arranged in the downstream side of the merging portion of the first connection line 132. The post-merger pressure determination unit 110 generates a post-merger pressure determination value by determining a pressure after the merging of the gases flowing out of the first-stage compressor bodies 101*a* and 101*b*. A cooler 109*a* is arranged at the first connection line 132. The cooler 109*a* cools the gas flowing inside the first connection line 132.

A cooler 109*b* is arranged at the second connection line 133. The cooler 109*b* cools the gas flowing inside the second connection line 133.

An outlet pressure determination unit 111 is arranged at the discharge line 131. The outlet pressure determination unit 111 generates an outlet pressure determination value by determining the pressure of the gas flowing out of the last-stage compressor body 102. Also, an outlet flow rate determination unit 115 is arranged at the discharge line 131. The outlet flow rate determination unit 115 generates an outlet flow rate determination value by determining the flow rate of the gas flowing out of the last-stage compressor body 102.

Next, a configuration of the compressor control device 200*a* in the second embodiment of the present invention will be described.

Figure 3:
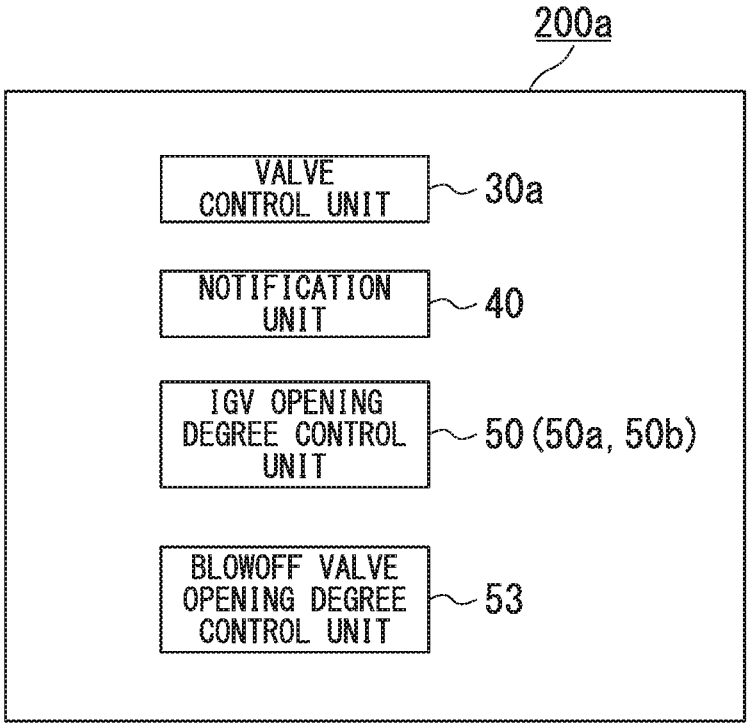
FIG. 3 is a diagram showing an example of a configuration of a compressor control device in the present embodiment.

FIG. 3 is a diagram showing an example of the configuration of the compressor control device 200*a* in the second embodiment of the present invention.

The compressor control device 200*a* in the second embodiment of the present invention includes a control unit 30*a*, a notification unit 40, IGV opening degree control units 50 (50*a* and 50*b*), and a blowoff valve opening degree control unit 53.

The IGV opening degree control unit 50*a* controls a degree of opening of the IGV 107*a*. The IGV opening degree control unit 50*b* controls a degree of opening of the IGV 107*b*. Configurations of the IGV opening degree control unit 50*a* and the IGV opening degree control unit 50*b* are identical.

The IGV opening degree control unit 50*a* includes an IGV opening degree command value generation unit 51 and an IGV opening degree command value correction unit 52*a*. The IGV opening degree control unit 50*b* includes an IGV opening degree command value generation unit 51 and an IGV opening degree command value correction unit 52*b*. The IGV opening degree command value generation unit 51 is common between the IGV opening degree control unit 50*a* and the IGV opening degree control unit 50*b*.

The IGV opening degree command value generation unit 51 generates and outputs an IGV opening degree command value indicating a degree of opening of the IGV 107*a*. The IGV opening degree command value generation unit 51 generates and outputs an IGV opening degree command value indicating a degree of opening of the IGV 107*b*. The IGV opening degree command value generation unit 51 includes a pressure controller 129 and a function generator 116.

The IGV opening degree command value correction units 52*a* and 52*b* correct an IGV opening degree command value output by the IGV opening degree command value generation unit 51.

The IGV opening degree command value correction unit 52*a* includes a flow rate indicator 125*a* which outputs an input inlet flow rate determination value as it is, a pressure indicator 126 which outputs an input post-merger pressure determination value as it is, and a function generator 117*a* which outputs an IGV opening degree correction value.

The IGV opening degree command value correction unit 52*b* includes a flow rate indicator 125*b* which outputs an input inlet flow rate determination value as it is, the pressure indicator 126 which outputs an input post-merger pressure determination value as it is, and a function generator 117*b* which outputs an IGV opening degree correction value.

The pressure indicator 126 is common between the IGV opening degree command value correction units 52*a* and 52*b*, but the present invention is not limited thereto.

The blowoff valve opening degree control unit 53 controls a degree of opening of the blowoff valve 108. The blowoff valve opening degree control unit 53 includes upstream-side anti-surge control units 54 (54*a* and 54*b*), an outlet pressure control unit 55, a downstream-side anti-surge control unit 56, and a command value selection unit 112.

Here, anti-surge control is control for maintaining a flow rate at a fixed value or more in order to prevent the compressor from being damaged by so-called surging caused by a decrease in the flow rate in the compressor.

The upstream-side anti-surge control unit 54*a* controls a degree of opening of the blowoff valve 108 in order to prevent surging from occurring in the first-stage compressor body 101*a*. The upstream-side anti-surge control unit 54*b* controls a degree of opening of the blowoff valve 108 in order to prevent surging from occurring in the first-stage compressor body 101*b*. Here, configurations of the upstream-side anti-surge control unit 54*a* and the upstream-side anti-surge control unit 54*b* are identical.

The upstream-side anti-surge control unit 54*a* includes a pressure indicator 126 which outputs an input post-merger outlet pressure determination value as it is, a function generator 118*a* which outputs an inlet flow rate target value, a flow rate indicator 125*a* which outputs an input inlet flow rate determination value as it is, and a flow rate controller 127*a* which outputs a blowoff valve opening degree command value on the basis of an inlet flow rate target value. The upstream-side anti-surge control unit 54*b* includes the pressure indicator 126 which outputs an input post-merger outlet pressure determination value as it is, a function generator 118*b* which outputs an inlet flow rate target value, a flow rate indicator 125*b* which outputs an input inlet flow rate determination value as it is, and a flow rate controller 127*b* which outputs a blowoff valve opening degree command value on the basis of an inlet flow rate target value.

Also, although the pressure indicator 126 is common between the upstream-side anti-surge control unit 54*a* and the upstream-side anti-surge control unit 54*b*, the present invention is not limited thereto.

The outlet pressure control unit 55 includes a pressure controller 129 which outputs an operation value for setting the input outlet pressure determination value to a setting value and a function generator 119 which outputs a blowoff valve opening degree command value.

The downstream-side anti-surge control unit 56 includes a function generator 120 which outputs an outlet flow rate target value and a flow rate controller 128 which outputs a blowoff valve opening degree command value on the basis of the outlet flow rate target value.

Also, the IGV opening degree command value correction unit 52*a* includes a performance difference correction coefficient generation unit 124, an inlet flow rate target value generation unit 122, and a function generator 121*a*. The IGV opening degree command value correction unit 52*b* includes the performance difference correction coefficient generation unit 124, the inlet flow rate target value generation unit 122, and a function generator 121*b*.

The performance difference correction coefficient generation unit 124 and the inlet flow rate target value generation unit 122 are common between the IGV opening degree command value correction unit 52*a* and the IGV opening degree command value correction unit 52*b*. The performance difference correction coefficient generation unit 124 generates and outputs a performance difference correction coefficient for correcting a performance difference between the two first-stage compressor bodies 101*a* and 101*b*. The performance difference correction coefficient and the inlet flow rate determination values in the first-stage compressor bodies 101*a* and 101*b* are input to the inlet flow rate target value generation unit 122 and inlet flow rate target values are generated for the first-stage compressor bodies 101*a* and 101*b*.

The inlet flow rate target values are input to the corresponding function generators 121*a* and 121*b*. The function generator 121*a* is provided in correspondence with a command value selection unit 113*a*. The function generator 121*b* is provided in correspondence with a command value selection unit 113*b*.

The inlet flow rate target value and the inlet flow rate determination value output from the corresponding flow rate indicator 125*a* are input to the function generator 121*a*. The inlet flow rate target value and the inlet flow rate determination value output from the corresponding flow rate indicator 125*b* are input to the function generator 121*b*. Function generators 121 (121*a* and 121*b*) generate and output IGV opening degree command correction values in proportion to a difference between the inlet flow rate target value and the inlet flow rate determination value. Here the function generators 121 (121*a* and 121*b*) may consider the integration of the difference between the inlet flow rate target value and the inlet flow rate determination value and generate and output the IGV opening degree command correction value.

The control unit 30*a* inputs an inlet flow rate determination value corresponding to the inlet flow rate determination unit 114*a* from the flow rate indicator 125*a*, an inlet flow rate determination value corresponding to the inlet flow rate determination unit 114*b* from the flow rate indicator 125*b*, and an output flow rate determination value of the outlet flow rate determination unit 115. The control unit 30*a* determines whether a malfunction is present in the multi-stage compressor system 1*a* on the basis of the inlet flow rate determination values and the output flow rate determination value.

Next, operations of the control unit 30*a* and the notification unit 40 provided in the compressor control device 200*a* according to the second embodiment will be described.

The control unit 30*a* inputs the inlet flow rate determination value corresponding to the inlet flow rate determination unit 114*a* from the flow rate indicator 125*a*, the inlet flow rate determination value corresponding to the inlet flow rate determination unit 114*b* from the flow rate indicator 125*b*, and an output flow rate determination value of the outlet flow rate determination unit 115. The control unit 30*a* designates the inlet flow rate determination value input from the flow rate indicator 125*a* as FI11. The control unit 30*a* designates the inlet flow rate determination value input from the flow rate indicator 125*b* as FI12. The control unit 30*a* designates the output flow rate determination value input from the outlet flow rate determination unit 115 as FC3. The control unit 30*a* determines whether an absolute value of (FI11+FI12−FC3) is greater than or equal to a predetermined reference value. This reference value is a value determined in consideration of a flow rate response delay or a gas leakage amount of a normal operation time, a drain flow rate in a compressor intercooler, or the like.

The control unit 30*a* determines that the multi-stage compressor system 1*a* is normal when the absolute value of (FI11+FI12−FC3) is less than the predetermined reference value.

Also, when the absolute value of (FI11+FI12−FC3) is greater than or equal to the predetermined reference value, the control unit 30*a* determines that a malfunction is occurring in the multi-stage compressor system 1*a*. In this case, the control unit 30*a* notifies the user that some malfunction is likely occurring in the multi-stage compressor system 1*a* via the notification unit 40. For example, the notification unit 40 is a display, a speaker, a vibration device, or the like. The notification unit 40 may display "Please confirm whether the measuring device is normal." or "Gas is likely leaking." or provide a notification by sound. Also, the notification unit 40 may cause the malfunction of the multi-stage compressor system 1*a* to be known by vibration.

Also, the control unit 30*a* may stop flow rate deviation correction when it is determined that a malfunction has likely occurred in the multi-stage compressor system 1*a*. Also, the control unit 30*a* may control the blowoff valve 108 to be opened to a fixed degree of opening in order to prevent a surge operation. In addition, the control unit 30*a* may stop the system.

As described above, in the multi-stage compressor system 1*a*, the control unit 30*a* compares the flow rates of gases taken in by the first-stage compressor bodies 101*a* and 101*b*, which are measured by the inlet flow rate determination units 114*a* and 114*b* (the first sensor), with the flow rate of a gas discharged by the last-stage compressor body 102, which is measured by the outlet flow rate determination unit 115 (the second sensor). When the flow rates of gases taken in by the first-stage compressor bodies 101, which are measured by the inlet flow rate determination units 114*a* and 114*b*, are different from the flow rate of a gas discharged by the last-stage compressor body 102, which is measured by the outlet flow rate determination unit 115, the control unit 30*a* determines that there is a possibility of a malfunction of the determination unit or gas leakage in the multi-stage compressor system 1*a*. The control unit 30*a* notifies the user of a possibility of some occurring malfunction in the multi-stage compressor system 1*a* via the notification unit 40.

Thus, the multi-stage compressor system 1*a* can detect a malfunction in the multi-stage compressor system 1*a* without making the measuring instrument redundant.

Third Embodiment

Figure 4:
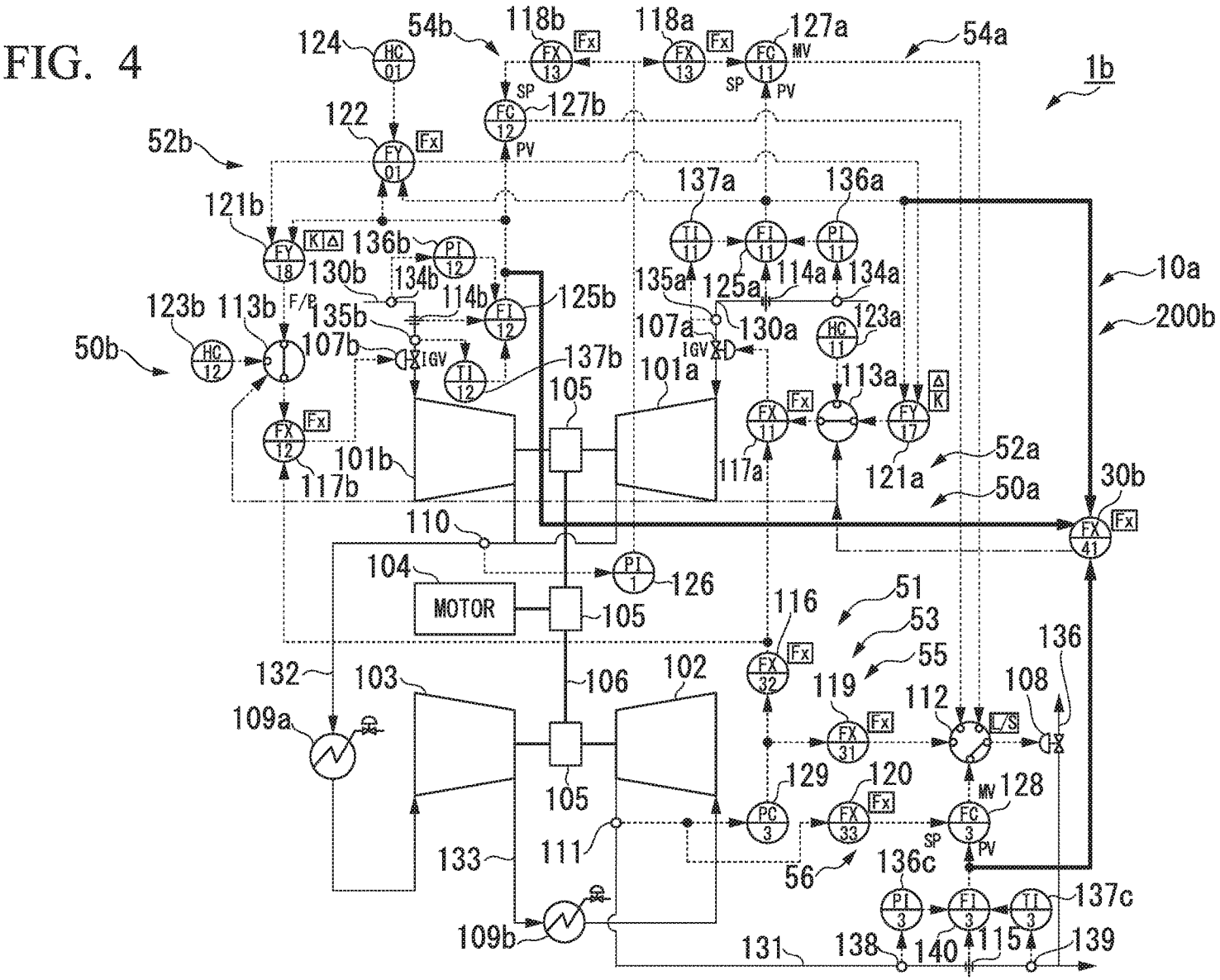
FIG. 4 is a diagram showing an example of a configuration of a multi-stage compressor system according to a third embodiment of the present invention.

FIG. 4 is a diagram showing an example of a configuration of a multi-stage compressor system 1*b* according to the third embodiment of the present invention.

The multi-stage compressor system according to the third embodiment 1*b* includes a multi-stage compressor 10*a* and a compressor control device 200*b* (a control device).

The multi-stage compressor system 1*b* according to the third embodiment is a system in which inlet pressure determination units 134 (134*a* and 134*b*), inlet temperature determination units 135 (135*a* and 135*b*), pressure indicators 136*a*, 136*b*, and 136*c*, and temperature indicators 137 (137*a*, 137*b*, and 137*c*), an outlet pressure determination unit 138, an outlet temperature determination unit 139, and a flow rate indicator 140 are added to the multi-stage compressor system 1*a* according to the second embodiment.

Here, a difference of the multi-stage compressor system 1*b* according to the third embodiment from the multi-stage compressor system 1*a* according to the second embodiment will be described.

The inlet pressure determination unit 134*a* generates an inlet pressure determination value by determining the pressure of the gas flowing into the first-stage compressor body 101*a*. The pressure indicator 136*a* outputs an inlet pressure determination value input from the inlet pressure determination unit 134*a* to the flow rate indicator 125*a*.

The inlet temperature determination unit 135*a* generates an inlet temperature determination value by determining the temperature of a gas flowing into the first-stage compressor body 101*a*. The temperature indicator 137*a* outputs the inlet temperature determination value input from the inlet temperature determination unit 135*a* to the flow rate indicator 125*a*.

The flow rate indicator 125*a* corrects a flow rate determination value on the basis of the input inlet pressure determination value and the input inlet temperature determination value.

The inlet pressure determination unit 134*b* generates an inlet pressure determination value by determining the pressure of a gas flowing into the first-stage compressor body 101*b*. The pressure indicator 136*b* outputs the inlet pressure determination value input from the inlet pressure determination unit 134*b* to the flow rate indicator 125*b*.

The inlet temperature determination unit 135*b* generates an inlet temperature determination value by determining the temperature of a gas flowing into the first-stage compressor body 101*b*. The temperature indicator 137*b* outputs the inlet temperature determination value input from the inlet temperature determination unit 135*b* to the flow rate indicator 125*b*.

The flow rate indicator 125*b* corrects a flow rate determination value on the basis of the input inlet pressure determination value and the input inlet temperature determination value.

The outlet pressure determination unit 138 generates an outlet pressure determination value by determining the pressure of a gas flowing out of the last-stage compressor body 102. The pressure indicator 136*c* outputs an outlet pressure determination value output from the outlet pressure determination unit 138 to the flow rate indicator 140.

The outlet temperature determination unit 139 generates an outlet temperature determination value by determining the temperature of the gas flowing out of the last-stage compressor body 102. The temperature indicator 137*c* outputs the outlet temperature determination value output from the outlet temperature determination unit 139 to the flow rate indicator 140.

The flow rate indicator 140 corrects a flow rate determination value on the basis of the input outlet pressure determination value and the input outlet temperature determination value.

The control unit 30*b* inputs an inlet flow rate determination value corresponding to the inlet flow rate determination unit 114*a* from the flow rate indicator 125*a*, an inlet flow rate determination value corresponding to the inlet flow rate determination unit 114*b* from the flow rate indicator 125*b*, and an outlet flow rate determination value from the flow rate indicator 140. The control unit 30*b* designates the inlet flow rate determination value input from the flow rate indicator 125*a* as FI11c. The control unit 30*b* designates the inlet flow rate determination value input from the flow rate indicator 125*b* as FI12c. The control unit 30*b* designates the output flow rate determination value input from the flow rate indicator 140 as FC3c. The control unit 30*b* determines whether an absolute value of (FI11c+FI12c−FC3c) is greater than or equal to a predetermined reference value. This reference value is a value determined in consideration of a flow rate response delay or a gas leakage amount of a normal operation time, a drain flow rate in a compressor intercooler, or the like.

The control unit 30*b* determines that the multi-stage compressor system 1*b* is normal when the absolute value of (FI11c+FI12c−FC3c) is less than the predetermined reference value.

Also, when the absolute value of (FI11c+FI12c−FC3c) is greater than or equal to the predetermined reference value, the control unit 30*b* determines that a malfunction is occurring in the multi-stage compressor system 1*b*. In this case, the control unit 30*b* notifies the user that some malfunction is likely occurring in the multi-stage compressor system 1*b* via the notification unit 40. For example, the notification unit 40 is a display, a speaker, a vibration device, or the like. The notification unit 40 may display "Please confirm whether the measuring device is normal." or "Gas is likely leaking." or provide a notification by sound. Also, the notification unit 40 may cause the malfunction of the multi-stage compressor system 1*b* to be known by vibration.

Also, the control unit 30*b* may stop flow rate deviation correction when it is determined that a malfunction is likely occurring in the multi-stage compressor system 1*b*. Also, the control unit 30*b* may control the blowoff valve 108 to be opened to a fixed degree of opening in order to prevent a surge operation. In addition, the control unit 30*b* may stop the system.

As described above, in the multi-stage compressor system 1*b*, the control unit 30*b* compares the flow rates of gases taken in by the first-stage compressor bodies 101*a* and 101*b*, which are measured by the inlet flow rate determination units 114*a* and 114*b* (the first sensor), with the flow rate of a gas discharged by the last-stage compressor body 102, which is measured by the outlet flow rate determination unit 115 (the second sensor). When the flow rates of gases taken in by the first-stage compressor bodies 101, which are measured by the inlet flow rate determination units 114*a* and 114*b*, are different from the flow rate of a gas discharged by the last-stage compressor body 102, which is measured by the outlet flow rate determination unit 115, the control unit 30*b* determines that there is a possibility of a malfunction of the determination unit or gas leakage in the multi-stage compressor system 1*b*. The control unit 30*b* notifies the user of a possibility of some occurring malfunction in the multi-stage compressor system 1*b* via the notification unit 40.

Thus, the multi-stage compressor system 1*b* can detect a malfunction in the multi-stage compressor system 1*b* without making the measuring instrument redundant.

Also, as described above, in the multi-stage compressor system 1*b*, the control unit 30*b* determines that there is a possibility of a malfunction of the determination unit or gas leakage in the multi-stage compressor system 1*b* using a corrected gas flow rate on the basis of a measurement value of a pressure or a temperature in addition to the control unit 30*a* in the multi-stage compressor system 1*a*.

Thereby, the control unit 30*b* can make a more accurate determination.

Also, when the pressure and temperature are measured as in the above-described example, it is desirable to measure a pressure upstream and measure a temperature downstream. This is because the turbulence of a gas flow due to the temperature measurement instrument is likely to affect measurement of the pressure when the temperature measurement instrument is located upstream and a pressure is measured downstream.

Also, although a flow rate is corrected on the basis of results of measuring a pressure and a temperature in the above-described example, the present invention is not limited thereto. A molecular weight of a gas may be measured and the flow rate may be corrected on the basis of the molecular weight. Thereby, it is possible to perform correction considering an influence by a gas other than the air and the control unit 30*b* can make a more accurate determination.

Fourth Embodiment

Figure 5:
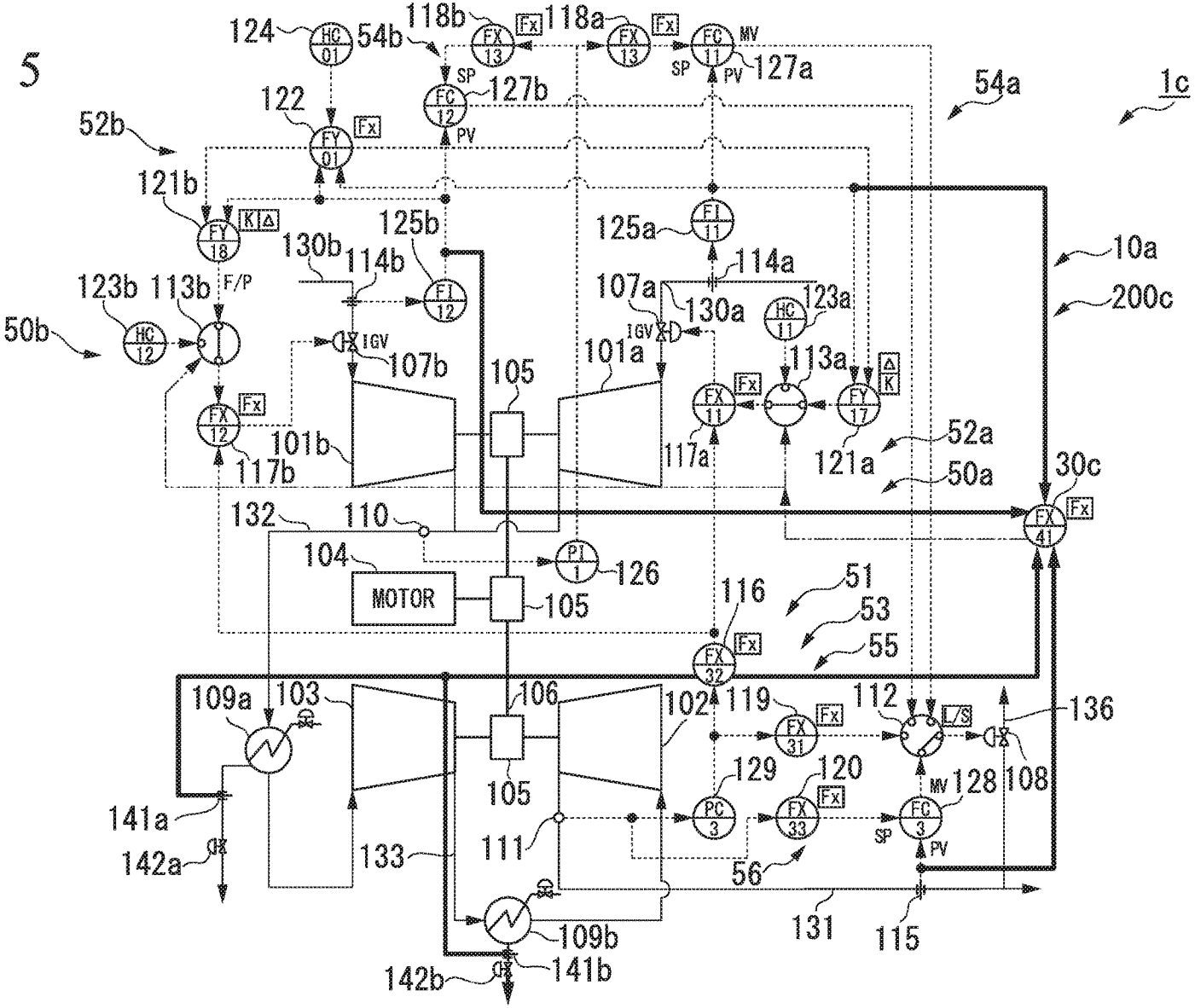
FIG. 5 is a diagram showing an example of a configuration of a multi-stage compressor system according to a fourth embodiment of the present invention.

FIG. 5 is a diagram showing an example of a configuration of a multi-stage compressor system 1*c* according to the fourth embodiment of the present invention.

The multi-stage compressor system 1*c* according to the fourth embodiment includes a multi-stage compressor 10*a* and a compressor control device 200*c*.

The multi-stage compressor system 1*c* according to the fourth embodiment is a system in which drain flow rate meters 141 (141*a* and 141*b*) and drain valves 142 (142*a* and 142*b*) are added to the multi-stage compressor system 1*a* according to the second embodiment.

Here, a difference of the multi-stage compressor system 1*c* according to the fourth embodiment from the multi-stage compressor system 1*a* according to the second embodiment will be described.

The drain flow rates during cooling by the coolers 109*a* and 109*b* are measured from the drain flow rate meters 141 (141*a* and 141*b*) or the flow rate is estimated on the basis of degrees of opening of the drain valves 142 (142*a* and 142*b*).

For example, correspondence relationships between drain flow rates and degrees of opening of the valves are pre-acquired by experiments and the like and recorded in a storage unit. The drain flow rate is estimated on the basis of the correspondence relationships.

The control unit 30*c* inputs an inlet flow rate determination value corresponding to the inlet flow rate determination unit 114*a* from the flow rate indicator 125*a*, an inlet flow rate determination value corresponding to the inlet flow rate determination unit 114*b* from the flow rate indicator 125*b*, and an outlet flow rate determination value of the outlet flow rate determination unit 115. The control unit 30*c* designates the inlet flow rate determination value input from the flow rate indicator 125*a* as FI11. The control unit 30*c* designates the inlet flow rate determination value input from the flow rate indicator 125*b* as FI12. The control unit 30*c* designates the output flow rate determination value input from the outlet flow rate determination unit 115 as FC3. The control unit 30*c* designates a drain flow rate sum input from the drain flow rate meter 141 or the drain valve 142 as ΣFL. The control unit 30*c* determines whether an absolute value of (FI11+FI12−FC3−ΣFL) is greater than or equal to a predetermined reference value. This reference value is a value determined in consideration of a flow rate response delay or a gas leakage amount of a normal operation time.

The control unit 30*c* determines that the multi-stage compressor system 1*c* is normal when the absolute value of (FI11+FI12−FC3−ΣFL) is less than the predetermined reference value.

Also, when the absolute value of (FI11+FI12−FC3−ΣFL) is greater than or equal to the predetermined reference value, the control unit 30*c* determines that a malfunction is occurring in the multi-stage compressor system 1*c*. In this case, the control unit 30*c* notifies the user that some malfunction is likely occurring in the multi-stage compressor system 1*c* via the notification unit 40. For example, the notification unit 40 is a display, a speaker, a vibration device, or the like. The notification unit 40 may display "Please confirm whether the measuring device is normal." or "Gas is likely leaking." or provide a notification by sound. Also, the notification unit 40 may cause the malfunction of the multi-stage compressor system 1*c* to be known by vibration.

Also, the control unit 30*c* may stop flow rate deviation correction when it is determined that a malfunction is likely occurring in the multi-stage compressor system 1*c*. Also, the control unit 30*c* may control the blowoff valve 108 to be opened to a fixed degree of opening in order to prevent a surge operation. In addition, the control unit 30*c* may stop the system.

Also, the drain flow rate may be estimated from relationships between input gas conditions (a temperature, a pressure, a humidity, etc.) and operation conditions (a temperature and a pressure).

As described above, in the multi-stage compressor system 1*c*, the control unit 30*c* compares the flow rates of gases taken in by the first-stage compressor bodies 101*a* and 101*b*, which are measured by the inlet flow rate determination units 114*a* and 114*b* (the first sensor), with the flow rate of a gas discharged by the last-stage compressor body 102, which is measured by the outlet flow rate determination unit 115 (the second sensor). When the flow rates of gases taken in by the first-stage compressor bodies 101, which are measured by the inlet flow rate determination units 114*a* and 114*b*, are different from the flow rate of a gas discharged by the last-stage compressor body 102, which is measured by the outlet flow rate determination unit 115, the control unit 30*c* determines that there is a possibility of a malfunction of the determination unit or gas leakage in the multi-stage compressor system 1*c*. The control unit 30*c* notifies the user of a possibility of some occurring malfunction in the multi-stage compressor system 1*c* via the notification unit 40.

Thereby, the multi-stage compressor system 1*c* can detect a malfunction in the multi-stage compressor system 1*c* without making the measuring instrument redundant.

Also, when the pressure and temperature are measured as in the above-described example, it is desirable to measure a pressure upstream and measure a temperature downstream. This is because the turbulence of a gas flow due to the temperature measurement instrument is likely to affect measurement of the pressure when the temperature measurement instrument is located upstream and a pressure is measured downstream.

Also, although a flow rate is corrected on the basis of results of measuring a pressure and a temperature in the above-described example, the present invention is not limited thereto. A molecular weight of a gas may be measured and the flow rate may be corrected on the basis of the molecular weight. Thereby, it is possible to perform correction considering an influence by a gas other than the air and the control unit 30*c* can make a more accurate determination.

Also, as described above, in the multi-stage compressor system 1*c*, the control unit 30*c* determines that there is a possibility of a malfunction of the determination unit or gas leakage in the multi-stage compressor system 1*c* using a drain flow rate in addition to the control unit 30*a* in the multi-stage compressor system 1*a*.

Thereby, the control unit 30*c* can make a more accurate determination.

Also, although an example shown in the above-described embodiment is an example in which the gas flow rate of the last-stage compressor body 102 is measured, the present invention is not limited thereto. The control unit may compare measurement values in compressor bodies of arbitrary different stages. In this case, the possibility of a malfunction of a measuring instrument used in measurement and the possibility of gas leakage between compressor bodies of two different stages are determined.

Also, an embodiment of the present invention has been described, but the above-described multi-stage compressor system 1 internally includes a computer system. Each process described above may be stored in a computer-readable recording medium in the form of a program. The above-described process is performed by the computer reading and executing the program. Here, the computer-readable recording medium may be a magnetic disk, a magneto-optical disc, a compact disc read-only memory (CD-ROM), a digital versatile disc-read only memory (DVD-ROM), a semiconductor memory, or the like. In addition, the computer program may be distributed to the computer through a communication line, and the computer receiving the distributed program may execute the program.

Also, the above-described program may be a program for implementing some of the above-described functions. Further, the above-described program may be a program, i.e., a so-called differential file (differential program), capable of implementing the above-described function in combination with a program already recorded on the computer system.

Although some embodiments of the present invention have been described, these embodiments have been proposed as examples and are not intended to limit the range of the invention. These embodiments can be executed in various other modes. Various omissions, replacements, and changes can be made in a range not departing from the scope of the invention.

INDUSTRIAL APPLICABILITY

According to the multi-stage compression system, the control device, the malfunction determination method, and the program described above, it is possible to detect a malfunction in a multi-stage compressor system without making a measuring instrument redundant.

REFERENCE SIGNS LIST

1, 1*a*, 1*b*, 1*c* Multi-stage compressor system
10, 10*a* Multi-stage compressor
20*a* First sensor
20*b* Second sensor
30, 30*a*, 30*b*, 30*c* Control unit
40 Notification unit
50*a*, 50*b* Inlet guide vanes (IGV) opening degree control unit
51 IGV opening degree command value generation unit
52*a*, 52*b* IGV opening degree command value correction unit
53 Blowoff valve opening degree control unit
54*a*, 54*b* Upstream-side anti-surge control unit
55 Outlet pressure control unit
56 Downstream-side anti-surge control unit
101, 101*a*, 101*b* First-stage compressor
102 Last-stage compressor
103 Second-stage compressor
104 Motor
105 Gearbox
106 Shaft
107*a*, 107*b* IGV
108 Blowoff valve
109*a*, 109*b* Cooler
110 Post-merger pressure determination unit
111, 138 Outlet pressure determination unit
112, 113*a*, 113*b* Command value selection unit
114*a*, 114*b* Inlet flow rate determination unit
115 Outlet flow rate determination unit
116, 117*a*, 117*b*, 118*a*, 118*b*, 119, 120, 121*a*, 121*b*, 122 Function generator
123*a*, 123*b* Correction cancellation signal generation unit
124 Performance difference correction coefficient generation unit
125*a*, 125*b*, 140 Flow rate indicator
126, 136*a*, 136*b*, 136*c* Pressure indicator
127*a*, 127*b*, 128 Flow rate controller
129 Pressure controller
130*a*, 130*b* Supply line
131 Discharge line
132 First connection line
133 Second connection line
134*a*, 134*b* Inlet pressure determination unit
135*a*, 135*b* Inlet temperature determination unit
136 Blowoff line
137*a*, 137*b*, 137*c* Temperature indicator
139 Outlet temperature determination unit
141*a*, 141*b* Drain flow rate meter
142*a*, 142*b* Drain valve
200*a*, 200*b* Compressor control device

What is claimed is:

1. A system of a multi-stage compressor in which compressors are connected in series in a plurality of stages, the multi-stage compressor system comprising:

a control unit configured to determine whether a malfunction is present in the system by comparing a suction flow rate of a first-stage compressor measured by a first sensor with a downstream flow rate from an outlet of the multi-stage compressor measured by a second sensor, and a blowoff valve disposed at a downstream side of the multi-stage compressor, wherein the control unit determines that the malfunction is present when a measurement value of the first sensor and a measurement value of the second sensor are not the same within a predetermined error range, and the control unit is configured to open the blowoff valve in a case that the malfunction is present.

2. The multi-stage compressor system according to claim 1, wherein the multi-stage compressor includes a pair of first-stage compressors and subsequent-stage compressors, wherein the subsequent-stage compressors serially connected to the first-stage compressors compress fluids compressed by the pair of first-stage compressors.

3. The multi-stage compressor system according to claim 2, wherein a measurement value of each of the first sensor and the second sensor is corrected according to at least one of a temperature of a fluid, a pressure of the fluid, and a molecular weight of the fluid in which the first sensor and the second sensor measure.

4. The multi-stage compressor system according to claim 1, wherein a measurement value of each of the first sensor and the second sensor is corrected according to at least one of a temperature of a fluid, a pressure of the fluid, and a molecular weight of the fluid in which the first sensor and the second sensor measure.

5. The multi-stage compressor system according to claim 4, wherein a pressure of a fluid is measured at an upstream side of the first sensor and a temperature of the fluid is measured at a downstream side of the first sensor.

6. A control device for a multi-stage compressor in which compressors are connected in series in a plurality of stages, the control device comprising:

a control unit configured to determine whether a malfunction is present in the system by comparing a suction flow rate of a first-stage compressor measured by a first sensor with a downstream flow rate from an outlet of the multi-stage compressor measured by a second sensor and determining that the malfunction is present when a measurement value of the first sensor and a measurement value of the second sensor are not the same within a predetermined error range, and the control unit is configured to open a blowoff valve which is disposed at a downstream side of the multi-stage compressor in a case that the malfunction is present.

7. The control device according to claim 6, wherein a measurement value of each of the first sensor and the second sensor is corrected according to at least one of a measured temperature of a fluid, a measured pressure of the fluid, and a measured molecular weight of the fluid around the sensor.

8. A malfunction determination method for use in a system of a multi-stage compressor in which compressors are connected in series in a plurality of stages, the malfunction determination method comprising:

determining, by a control unit, whether a malfunction is present in the system by comparing a suction flow rate of a first-stage compressor measured by a first sensor with a downstream flow rate from an outlet of the multi-stage compressor measured by a second sensor, and determining that the malfunction is present when a measurement value of the first sensor and a measurement value of the second sensor are not the same within a predetermined error range, and opening a blowoff valve which is disposed at a downstream side of the multi-stage compressor in a case that the malfunction is present.

9. The malfunction determination method according to claim 8, wherein the multi-stage compressor includes a pair of first-stage compressors and sub sequent-stage compressors, wherein the subsequent-stage compressors serially connected to the first-stage compressors compress fluids compressed by the pair of first-stage compressors.

10. The malfunction determination method according to claim 8, wherein a measurement value of each of the first sensor and the second sensor is corrected according to at least one of a temperature of a fluid, a pressure of the fluid, and a molecular weight of the fluid in which the first sensor and the second sensor measure.

11. The malfunction determination method according to claim 10, wherein a pressure of a fluid is measured at an upstream side of the first sensor and a temperature of the fluid is measured at a downstream side of the first sensor.

12. A non-transitory computer readable medium storing a program configured to cause a computer of a control device for controlling a multi-stage compressor in which compressors are connected in series in a plurality of stages to function as:

a control means configured to determine whether a malfunction is present in the system by comparing a suction flow rate of a first-stage compressor measured by a first sensor with a downstream flow rate from an outlet of the multi-stage compressor measured by a second sensor, and the control means being configured to determine that the malfunction is present when a measurement value of the first sensor and a measurement value of the second sensor are not the same within a predetermined error range, and the control means being configured to open a blowoff valve which is disposed at a downstream side of the multi-stage compressor in a case that the malfunction is present.

13. The non-transitory computer readable medium storing the program according to claim 12, wherein the program causes the computer to function as:

a means configured to correct a measurement value of each of the first sensor and the second sensor according to at least one of a measured temperature of a fluid, a measured pressure of the fluid, and a measured molecular weight of the fluid around the sensor.

* * * * *